US007773055B2

(12) United States Patent
You et al.

(10) Patent No.: US 7,773,055 B2
(45) Date of Patent: Aug. 10, 2010

(54) DISPLAY DEVICE AND DRIVING METHOD THEREOF

(75) Inventors: Bong-Hyun You, Gyeonggi-do (KR); Min-Koo Han, Seoul (KR)

(73) Assignees: Samsung Electronics Co., Ltd., Gyeonggi-do (KR); Seoul National University Industry, Seoul (KR)

( * ) Notice: Subject to any disclaimer, the term of this patent is extended or adjusted under 35 U.S.C. 154(b) by 966 days.

(21) Appl. No.: 11/243,074

(22) Filed: Oct. 3, 2005

(65) Prior Publication Data

US 2006/0221004 A1 Oct. 5, 2006

(30) Foreign Application Priority Data

Apr. 4, 2005 (KR) ..... 10-2005-0027978

(51) Int. Cl.
*G09G 3/30* (2006.01)

(52) U.S. Cl. ..... 345/76; 315/169.3

(58) Field of Classification Search ..... 345/76–83; 315/169.3

See application file for complete search history.

(56) References Cited

U.S. PATENT DOCUMENTS 7,009,590 B2 * 3/2006 Numao ..... 345/76
7,151,513 B2 * 12/2006 Li et al. ..... 345/76
2006/0097965 A1 * 5/2006 Deane et al. ..... 345/76

OTHER PUBLICATIONS

*New Pixel Circuit to Recover Vth Shift in a-Si TFT for Active Matrix OLEDs* Meeting Abstracts, Table of Contents—MA Feb. 2004; 2004 Joint International Meeting Oct. 3-8, 2004; 206th Meeting of The Electrochemical Society (ECS); 2004 Fall Meeting of The Electrochemical Society of Japan (ECSJ); ©2004 The Electrochemical Society.

* cited by examiner

*Primary Examiner*—Sumati Lefkowitz
*Assistant Examiner*—Seokyun Moon
(74) *Attorney, Agent, or Firm*—Innovation Counsel LLP

(57) ABSTRACT

A display device including a plurality of pixels is provided, each pixel includes: a light emitting element; first and second driving transistors connected between a driving voltage and the light emitting element and supplying a driving current to the light emitting element; a first switching transistor transmitting a data voltage to the first driving transistor; a second switching transistor transmitting a data voltage to the second driving transistor; a first inverter generating an inversion voltage having a polarity opposite the data voltage and applying the inversion voltage to the first driving transistor; and a second inverter generating an inversion voltage having a polarity opposite the data voltage and applying the inversion voltage to the second driving transistor.

19 Claims, 11 Drawing Sheets

DISPLAY DEVICE AND DRIVING METHOD THEREOF

CROSS-REFERENCE TO RELATED APPLICATION

This application claims priority from Korean Application No. 10-2005-00027978 filed on Apr. 4, 2005 under 35 USC 119, the content of which is incorporated by reference herein in its entirety.

BACKGROUND OF THE INVENTION (a) Field of the Invention

The present invention relates to a display device and a driving method thereof, and in particular, a light emitting display device and a driving method thereof.

(b) Description of Related Art

The flat panel displays include a liquid crystal display (LCD), field emission display (FED), organic light emitting diode (OLED) display, plasma display panel (PDP), and so on.

Generally, an active matrix flat panel display includes a plurality of pixels arranged in a matrix and displays images by controlling the luminance of the pixels based on given luminance information. An OLED display is a self-emissive display device that displays image by electrically exciting light emitting organic material, and it has low power consumption, wide viewing angle, and fast response time, thereby being advantageous for displaying motion images.

A pixel of an OLED display includes an OLED and a driving thin film transistor (TFT). The OLED emits light having an intensity depending on the current driven by the driving TFT, which in turn depends on the threshold voltage of the driving TFT and the voltage between gate and source of the driving TFT.

The TFT includes polysilicon or amorphous silicon. A polysilicon TFT has several advantages, but it also has disadvantages such as the complexity of manufacturing polysilicon, thereby increasing the manufacturing cost. In addition, it is hard to make an OLED display employing polysilicon TFTs be large.

On the contrary, an amorphous silicon TFT is easily applicable to a large OLED display and manufactured by less number of process steps than the polysilicon TFT. However, the threshold voltage of the amorphous silicon TFT shifts as time goes due to a long-time application of a unidirectional voltage to a gate of the TFT such that the current flowing in the OLED is non-uniform to degrade image quality and the lifetime of the OLED is shortened.

SUMMARY OF THE INVENTION

The present invention solves the problems of conventional techniques.

A display device including a plurality of pixels is provided, each pixel includes: a light emitting element; first and second driving transistors connected between a driving voltage and the light emitting element and supplying a driving current to the light emitting element; a first switching transistor transmitting a data voltage to the first driving transistor; a second switching transistor transmitting a data voltage to the second driving transistor; a first inverter generating an inversion voltage having a polarity opposite the data voltage and applying the inversion voltage to the first driving transistor; and a second inverter generating an inversion voltage having a polarity opposite the data voltage and applying the inversion voltage to the second driving transistor.

The first and the second driving transistors may alternately output the driving current frame by frame.

The first and the second switching transistors may alternately turn on and off frame by frame.

The first and the second inverters may alternately generate the inversion voltage frame by frame.

When the data voltage is applied to the first driving transistor, the inversion voltage may be applied to the second driving transistor, and when the data voltage is applied to the second driving transistor, the inversion voltage may be applied to the first driving transistor.

The inversion voltage may have a magnitude substantially proportional to a magnitude of the data voltage.

The display device may further include: a first capacitor storing the data voltage and the inversion voltage and supplying the data voltage and the inversion voltage to the first driving transistor; and a second capacitor storing the data voltage and the inversion voltage and supplying the data voltage and the inversion voltage to the second driving transistor.

When the first capacitor supplies the data voltage, the second capacitor may supply the inversion voltage, and when the second capacitor supplies the data voltage, the first capacitor may supply the inversion voltage.

The display device may further include: a data line supplying the data voltage; and a first scanning line transmitting a first scanning signal to the first switching transistor; and a second scanning line transmitting a second scanning signal to the second switching transistor.

The first inverter may include: a first thin film transistor connected to the driving voltage and having a diode connection; and a second thin film transistor connected between the first thin film transistor the first scanning line and transmitting the inversion voltage according to the data voltage. The second inverter may include: a third thin film transistor connected to the driving voltage and having a diode connection; and a fourth thin film transistor connected between the third thin film transistor the second scanning line and transmitting the inversion voltage according to the data voltage.

The first inverter may include: a fifth thin film transistor operating in response to the second scanning signal and connected between the first driving transistor and a node between the first thin film transistor and the second thin film transistor; and a sixth thin film transistor operating in response to the second scanning signal and connected between the second driving transistor and the first scanning line. The second inverter may include: a seventh thin film transistor operating in response to the first scanning signal and connected between the second driving transistor and a node between the third thin film transistor and the fourth thin film transistor; and a eighth thin film transistor operating in response to the first scanning signal and connected between the fourth thin film transistor and the second scanning line.

A display device according to an embodiment includes: a light emitting element; a first driving transistor having an input terminal connected to a driving voltage, an output terminal connected to the light emitting element, and a control terminal; a second driving transistor having an input terminal connected to a driving voltage, an output terminal connected to the light emitting element, and a control terminal; a first switching transistor operating in response to a first scanning signal and connected between a data voltage and the control terminal of the first driving transistor; a second switching transistor operating in response to a second scanning signal and connected between a data voltage and the control terminal of the second driving transistor; a first thin film transistor connected to the driving voltage and having a diode connection; a second thin film transistor operating the data voltage and connected between the first thin film transistor and the first scanning signal; a third thin film transistor connected to the driving voltage and having a diode connection; and a second thin film transistor operating the data voltage and connected between the third thin film transistor and the second scanning signal.

The display device may further include: a first capacitor connected between the control terminal of the first driving transistor; and a second capacitor connected between the control terminal of the second driving transistor.

The display device may further include: a data line supplying the data voltage; and a first scanning line transmitting the first scanning signal; and a second scanning line transmitting the second scanning signal.

The display device may further include: a fifth thin film transistor operating in response to the second scanning signal and connected between the second thin film transistor and the first driving transistor; a sixth thin film transistor operating in response to the second scanning signal and connected between the second thin film transistor and the first scanning signal; a seventh thin film transistor operating in response to the first scanning signal and connected between the fourth thin film transistor and the second driving transistor; and a eighth thin film transistor operating in response to the first scanning signal and connected between the fourth thin film transistor and the second scanning signal.

The first and the second signals may alternately become a gate-on voltage.

The inversion voltage may have a magnitude substantially in proportion to a magnitude of the data voltage.

A method of driving a display device according to an embodiment of the present invention is provided. The display device includes a light emitting element, first and second driving transistors connected to the light emitting element, first and second capacitors connected to the first and the second driving transistors, respectively, and first and second switching transistors connected between a data voltage and the first and the second driving transistors, respectively. The method includes: applying to the first driving transistor to the data voltage in a first frame; generating a first inversion voltage having a polarity opposite the data voltage according to the data voltage in the first frame; applying the first inversion voltage to the second driving transistor in the first frame; applying the data voltage to the second driving transistor in a second frame following the first frame; generating a second inversion voltage having a polarity opposite the data voltage according to the data voltage in the second frame; and applying the second inversion voltage to the first driving transistor in the second frame.

The method may further include: applying the data voltage to the first capacitor in the first frame; applying the first inversion voltage to the second capacitor in the first frame; applying the second inversion voltage to the first capacitor in the second frame; and applying the data voltage to the second capacitor in the second frame.

Each of the first and the second inversion voltages may have a magnitude substantially proportional to a magnitude of the data voltage.

BRIEF DESCRIPTION OF THE DRAWINGS

The present invention will become more apparent by describing embodiments thereof in detail with reference to the accompanying drawing in which.

DETAILED DESCRIPTION OF EMBODIMENTS

Figure 1:
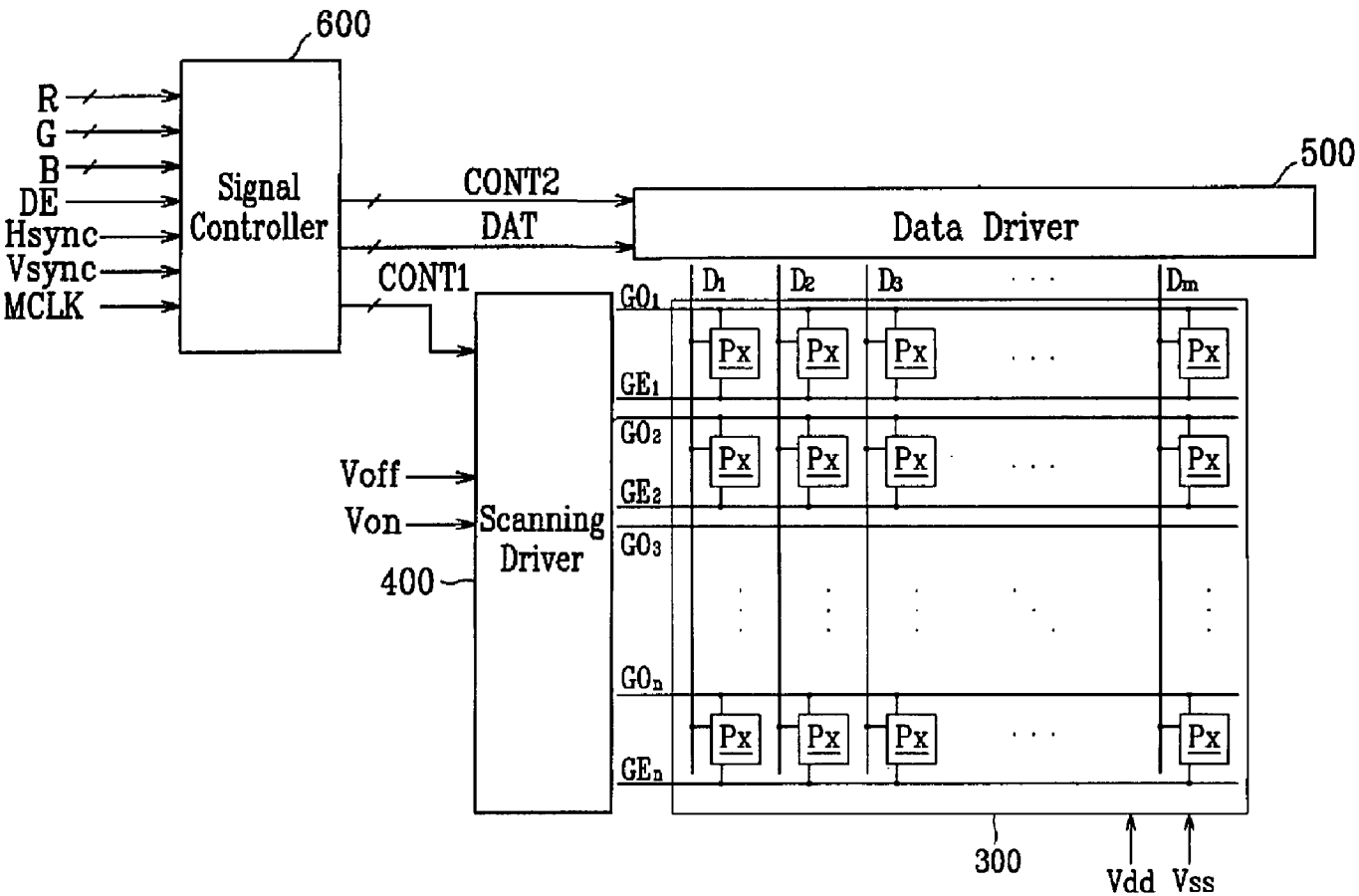
FIG. 1 is a block diagram of an OLED display according to an embodiment of the present invention.

The present invention now will be described more fully hereinafter with reference to the accompanying drawings, in which preferred embodiments of the invention are shown.

In the drawings, the thickness of layers and regions are exaggerated for clarity. Like numerals refer to like elements throughout. It will be understood that when an element such as a layer, region or substrate is referred to as being "on" another element, it can be directly on the other element or intervening elements may also be present. In contrast, when an element is referred to as being "directly on" another element, there are no intervening elements present.

Then, display devices and driving methods thereof according to embodiments of the present invention will be described with reference to the accompanying drawings.

Referring to FIGS. 1-4, an organic light emitting diode (OLED) display according to an embodiment of the present invention will be described in detail.

Figure 2:
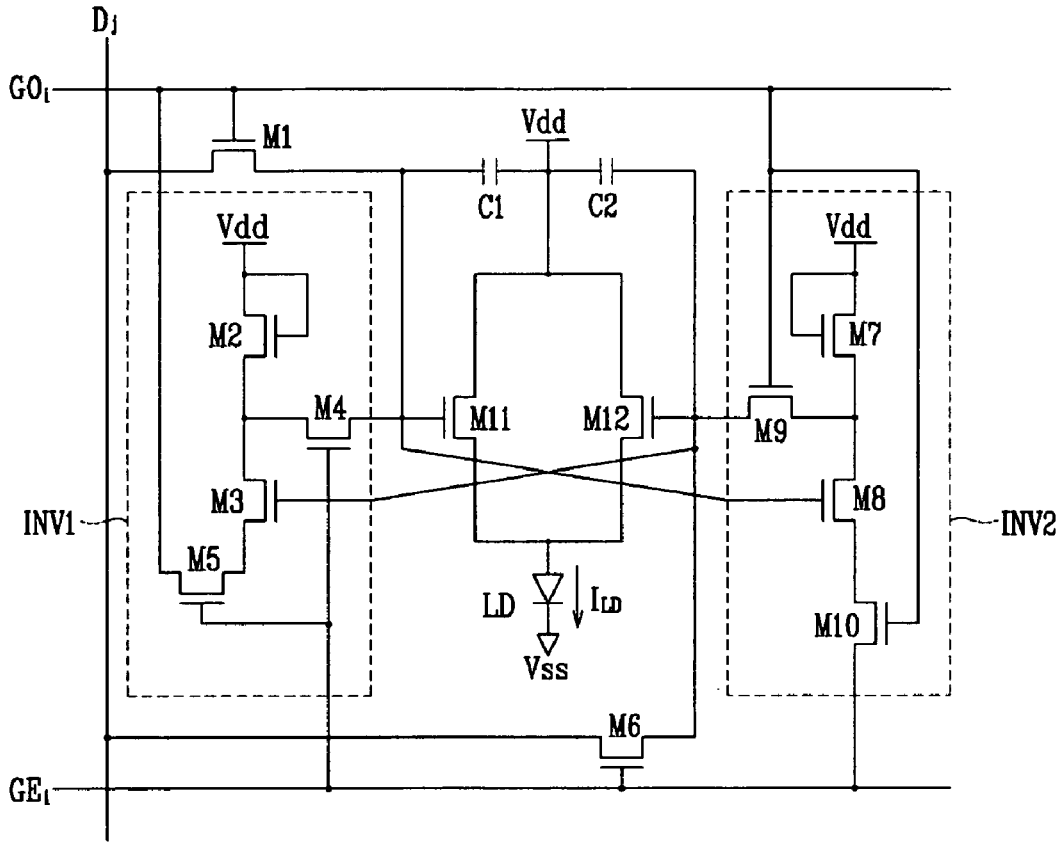
FIG. 2 is an equivalent circuit diagram of a pixel of an OLED display according to an embodiment of the present invention.

FIG. 1 is a block diagram of an OLED display according to an embodiment of the present invention and FIG. 2 is an equivalent circuit diagram of a pixel of an OLED display according to an embodiment of the present invention.

Referring to FIG. 1, an OLED display according to an embodiment includes a display panel 300, a scanning driver 400 and a data driver 500 that are connected to the display panel 300, and a signal controller 600 controlling the above elements.

Referring to FIG. 1, the display panel 300 includes a plurality of signal lines and a plurality of pixels Px connected thereto and arranged substantially in a matrix.

The signal lines include a plurality of first and second scanning lines $GO_1$-$GO_n$ and $GE_1$-$GE_n$ transmitting scanning signals and a plurality of data lines $D_1$-$D_m$ transmitting data signals. The scanning lines $GO_1$-$GE_n$ extend substantially in a row direction and substantially parallel to each other, while the data lines $D_1$-$D_m$ extend substantially in a column direction and substantially parallel to each other. The signal lines may further include a plurality of driving voltage lines (not shown) transmitting a driving voltage.

Referring to FIG. 2, each pixel Px, for example, a pixel at the i-th row and the j-th column includes an organic light emitting diode (OLED) LD, a pair of driving transistors M11 and M12, a pair of capacitors C1 and C2, a pair of switching transistors M1 and M6, and a pair of inverters INV1 and INV2.

Each of the driving transistors M11 and M12 has a control terminal coupled to one of the switching transistors M1 and M6 and one of the inverters INV1 and INV2, an input terminal coupled to a driving voltage Vdd, and an output coupled to the organic light emitting diode LD.

The switching transistor M1 has a control terminal connected to a first scanning line $GO_i$, an input terminal connected to a data line $D_j$, and an output terminal connected to the driving transistor M11. The switching transistor M6 has a control terminal connected to a second scanning line $GE_i$, an input terminal connected to the data line $D_j$, and an output terminal connected to the driving transistor M12. The switching transistor M1/M6 transmits the data signal applied to the data line $D_i$ to the driving transistor M11/M12 in response to the scanning signal applied to the scanning line $GO_i/GE_i$.

The inverter INV1 includes four transistors M2, M3, M4 and M5. The transistor M2 is in a diode connection, the transistor M3 operates according to the data voltages, and the transistors M4 and M5 operates according to the scanning signals. The transistors M2, M3 and M5 are connected in series between the driving voltage Vdd and the first scanning line $GO_i$, and the transistor M4 is connected between the control terminal of the driving transistor M11 and a node between the transistors M2 and M3.

The inverter INV2 also includes four transistors M7, M8, M9 and M10. The transistor M7 is in a diode connection, the transistor M8 operates according to the data voltages, and the transistors M9 and M10 operates according to the scanning signals. The transistors M7, M8 and M10 are connected in series between the driving voltage Vdd and the second scanning line $GE_i$, and the transistor M9 is connected between the control terminal of the driving transistor M12 and a node between the transistors M7 and M8.

The inverters INV1 and INV2 generate inversion voltages Vinv depending on the data voltages.

The capacitor C1/C2 is connected between the control terminal and the input terminal of the driving transistor M11/M12. The capacitors C1 and C2 store and maintain the data voltages or the inversion voltages applied to the control terminals of the driving transistors M11 and M12.

The OLED LD has an anode connected to the output terminal of the driving transistors M11 and M12 and a cathode connected to a common voltage Vss. The OLED LD emits light having an intensity depending on an output current $I_{LD}$ of the driving transistors M11 and M12. The output current $I_{LD}$ of the driving transistors M11 and M12 depends on the voltage between the control terminal and the output terminal of the driving transistors M11 and M12.

A set of the driving transistor M11, the switching transistor M1, the capacitor C1, and the inverter INV1 and a set of the driving transistor M12, the switching transistor M6, the capacitor C2, and the inverter INV2 have a symmetrical configuration.

The transistors M1-M12 are n-channel field effect transistors (FETs) including amorphous silicon or polysilicon. However, the transistors M1-M12 may be p-channel FETs operating in a manner opposite to n-channel FETs.

Now, a structure of an OLED and a driving transistor connected thereto shown in FIG. 2 will be described in detail with reference to FIGS. 3 and 4.

Figure 3:
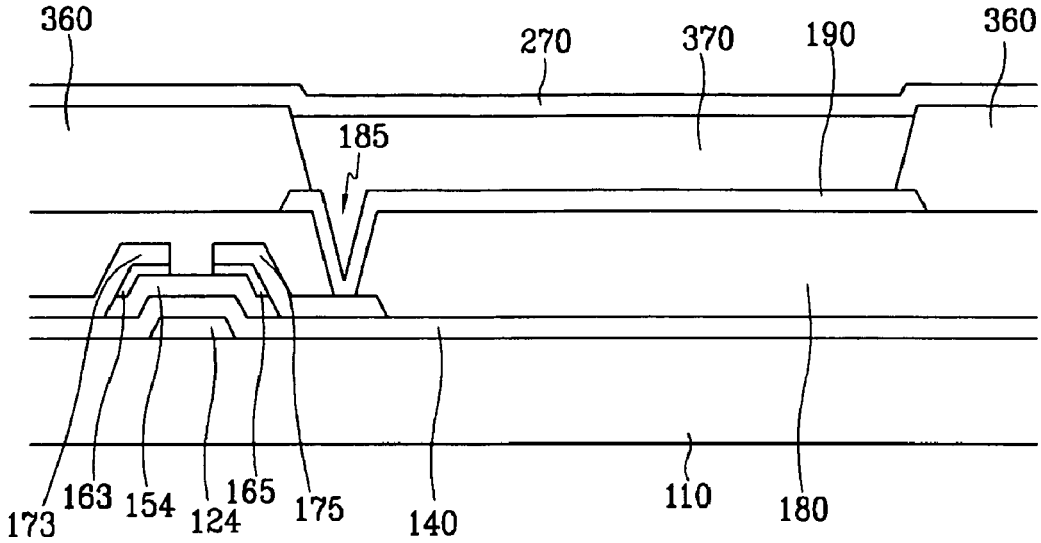
FIG. 3 is an exemplary sectional view of an OLED and a driving transistor shown in FIG. 2.
Figure 4:
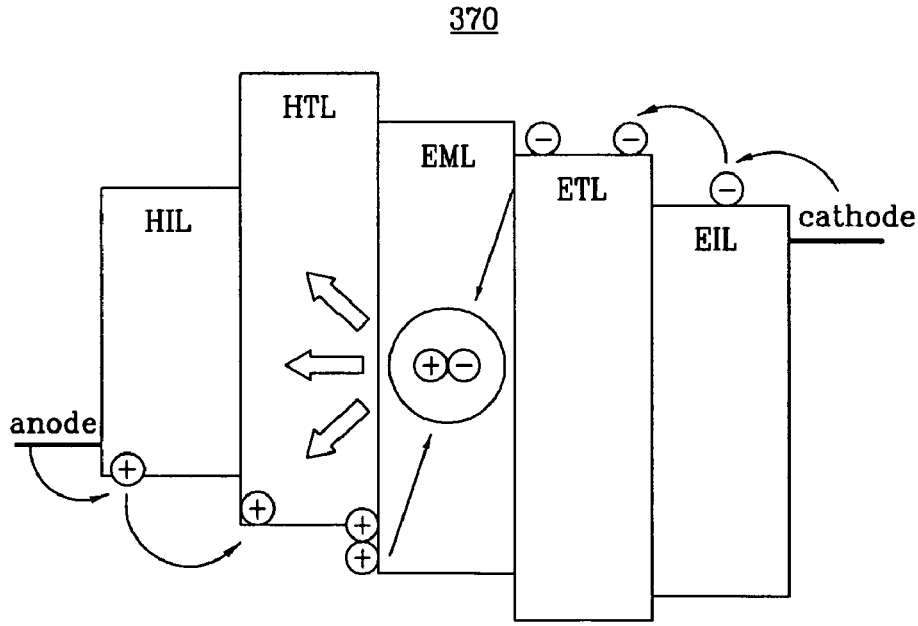
FIG. 4 is a schematic diagram of an OLED according to an embodiment of the present invention.

FIG. 3 is an exemplary sectional view of an OLED and a driving transistor shown in FIG. 2 and FIG. 4 is a schematic diagram of an OLED according to an embodiment of the present invention.

A control electrode 124 is formed on an insulating substrate 110. The control electrode 124 preferably made of Al containing metal such as Al and Al alloy, Ag containing metal such as Ag and Ag alloy, Cu containing metal such as Cu and Cu alloy, Mo containing metal such as Mo and Mo alloy, Cr, Ti or Ta. The control electrode 124 may have a multi-layered structure including two films having different physical characteristics. One of the two films is preferably made of low resistivity metal including Al containing metal, Ag containing metal, and Cu containing metal for reducing signal delay or voltage drop. The other film is preferably made of material such as Mo containing metal, Cr, Ta or Ti, which has good physical, chemical, and electrical contact characteristics with other materials such as indium tin oxide (ITO) or indium zinc oxide (IZO). Good examples of the combination of the two films are a lower Cr film and an upper Al (alloy) film and a lower Al (alloy) film and an upper Mo (alloy) film. However, the gate electrode 124 may be made of various metals or conductors. The lateral sides of the gate electrode 124 are inclined relative to a surface of the substrate, and the inclination angle thereof ranges about 30-80 degrees.

An insulating layer 140 preferably made of silicon nitride (SiNx) is formed on the control electrode 124.

A semiconductor 154 preferably made of hydrogenated amorphous silicon (abbreviated to "a-Si") or polysilicon is formed on the insulating layer 140, and a pair of ohmic contacts 163 and 165 preferably made of silicide or n+ hydrogenated a-Si heavily doped with n type impurity such as phosphorous are formed on the semiconductor 154. The lateral sides of the semiconductor 154 and the ohmic contacts 163 and 165 are inclined relative to the surface of the substrate, and the inclination angles thereof are preferably in a range of about 30-80 degrees.

An input electrode 173 and an output electrode 175 are formed on the ohmic contacts 163 and 165 and the insulating layer 140. The input electrode 173 and the output electrode 175 are preferably made of refractory metal such as Cr, Mo, Ti, Ta or alloys thereof. However, they may have a multilayered structure including a refractory metal film (not shown) and a low resistivity film (not shown). Good example of the multi-layered structure are a double-layered structure including a lower Cr/Mo (alloy) film and an upper Al (alloy) film and a triple-layered structure of a lower Mo (alloy) film, an intermediate Al (alloy) film, and an upper Mo (alloy) film. Like the gate electrode 124, the input electrode 173 and the output electrode 175 have inclined edge profiles, and the inclination angles thereof range about 30-80 degrees.

The input electrode 173 and the output electrode 175 are separated from each other and disposed opposite each other with respect to a gate electrode 124. The control electrode 124, the input electrode 173, and the output electrode 175 as well as the semiconductor 154 form a TFT serving as a driving transistor M11 or M12 having a channel located between the input electrode 173 and the output electrode 175.

The ohmic contacts 163 and 165 are interposed only between the underlying semiconductor stripes 151 and the overlying electrodes 173 and 175 thereon and reduce the contact resistance therebetween. The semiconductor 154 includes an exposed portion, which are not covered with the input electrode 173 and the output electrode 175.

A passivation layer 180 is formed on the electrode 173 and 175, the exposed portion of the semiconductor 154, and the insulating layer 140. The passivation layer 180 is preferably made of inorganic insulator such as silicon nitride or silicon oxide, organic insulator, or low dielectric insulating material. The low dielectric material preferably has dielectric constant lower than 4.0 and examples thereof are a-Si:C:O and a-Si:

O:F formed by plasma enhanced chemical vapor deposition (PECVD). The organic insulator may have photosensitivity and the passivation layer 180 may have a flat surface. The passivation layer 180 may be made of material having flatness characteristics and photosensitivity. The passivation layer 180 may have a double-layered structure including a lower inorganic film and an upper organic film so that it may take the advantage of the organic film as well as it may protect the exposed portions of the semiconductor 154. The passivation layer 180 has a 185 exposing a portion of the output electrode 175.

A pixel electrode 190 is formed on the passivation layer 180. The pixel electrode 190 is physically and electrically connected to the output terminal electrode 175 through the contact hole 185 and it is preferably made of transparent conductor such as ITO or IZO or reflective metal such as Cr, Ag or Al.

A partition 360 is formed on the passivation layer 180. The partition 360 encloses the pixel electrode 190 to define an opening on the pixel electrode 190 like a bank, and it is preferably made of organic or inorganic insulating material.

An organic light emitting member 370 is formed on the pixel electrode 190 and it is confined in the opening enclosed by the partition 360.

Referring to FIG. 4, the organic light emitting member 370 has a multilayered structure including an emitting layer EML and auxiliary layers for improving the efficiency of light emission of the emitting layer EML. The auxiliary layers include an electron transport layer ETL and a hole transport layer HTL for improving the balance of the electrons and holes and an electron injecting layer EIL and a hole injecting layer HIL for improving the injection of the electrons and holes. The auxiliary layers may be omitted.

A common electrode 270 supplied with a common voltage Vss is formed on the organic light emitting member 370 and the partition 360. The common electrode 270 is preferably made of reflective metal such as Ca, Ba, Cr, Al or Ag, or transparent conductive material such as ITO or IZO.

A combination of opaque pixel electrodes 190 and a transparent common electrode 270 is employed to a top emission OLED display that emits light toward the top of the display panel 300, and a combination of transparent pixel electrodes 190 and a opaque common electrode 270 is employed to a bottom emission OLED display that emits light toward the bottom of the display panel 300.

A pixel electrode 190, an organic light emitting member 370, and a common electrode 270 form an OLED LD having the pixel electrode 190 as an anode and the common electrode 270 as a cathode or vice versa. The OLED LD uniquely emits one of primary color lights depending on the material of the light emitting member 380. An exemplary set of the primary colors includes red, green, and blue and the display of images is realized by the addition of the three primary colors.

Referring to FIG. 1 again, the scanning driver 400 is connected to the scanning lines $GO_1$-$GO_n$ and $GE_1$-$GE_n$ of the display panel 300 and synthesizes a gate-on voltage Von for turning on the transistors M1, M4-M6 and M10 and a gate-off voltage Voff for turning off the transistors M1, M4-M6 and M10 to generate scanning signals for application to the scanning lines $GO_1$-$GO_n$ and $GE_1$-$GE_n$.

The data driver 500 is connected to the data lines $D_1$-$D_m$ of the display panel 300 and applies data voltages to the data lines $D_1$-$D_m$.

The scanning driver 400 or the data driver 500 may be implemented as integrated circuit (IC) chip mounted on the display panel 300 or on a flexible printed circuit (FPC) film in a tape carrier package (TCP) type, which are attached to the display panel 300. Alternately, they may be integrated into the display panel 300 along with the signal lines $GO_1$-$GO_n$ and $GE_1$-$GE_n$ and $D_1$-$D_m$ and the transistors M1, M4-M6 and M10.

The signal controller 600 controls the scanning driver 400 and the data driver 500.

Now, the operation of the above-described OLED display will be described in detail with reference to FIGS. 5, 6 and 7 as well as FIG. 1.

Figure 5:
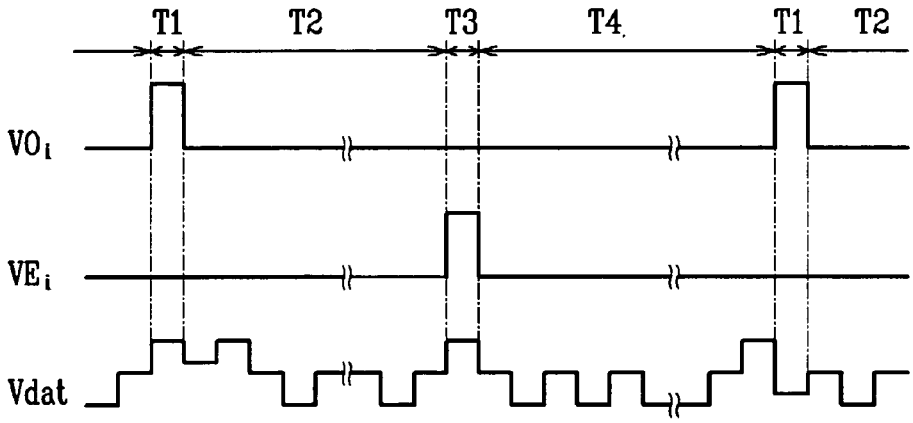
FIG. 5 is a timing chart of signals in an OLED display according to an embodiment of the present invention.
Figure 6A:
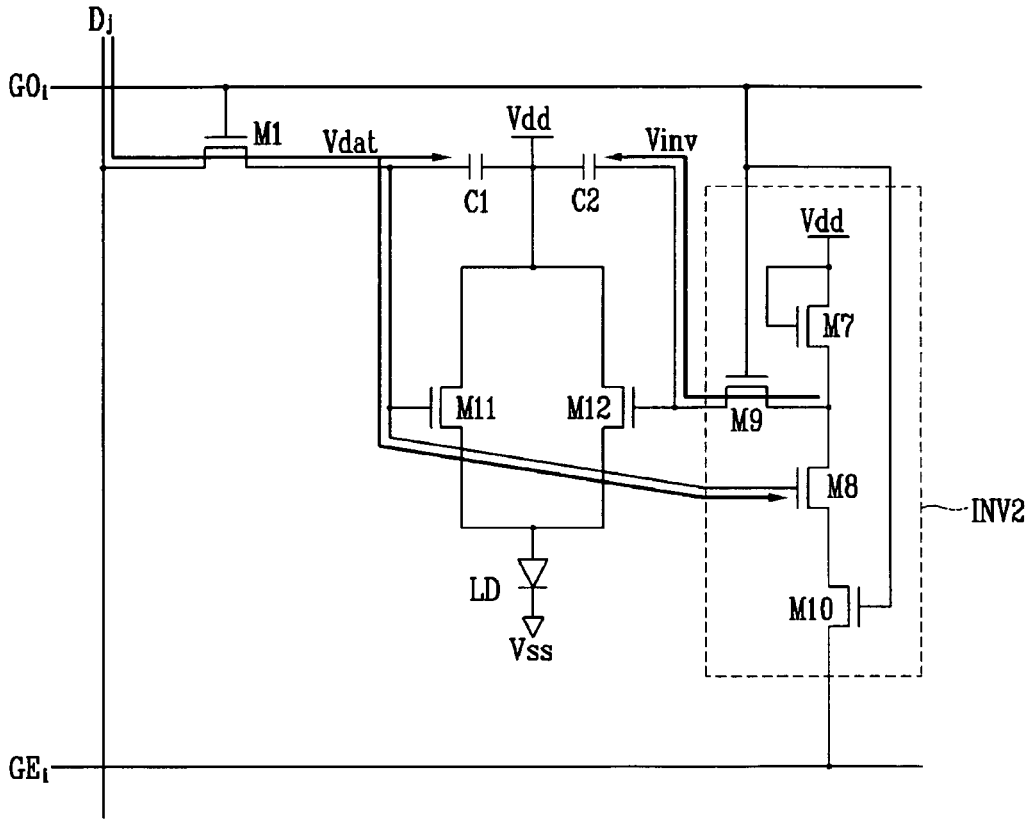
FIGS. 6A, 6B, 6C and 6D are equivalent circuit diagrams of a pixel in time periods shown in FIG. 5.
Figure 6B:
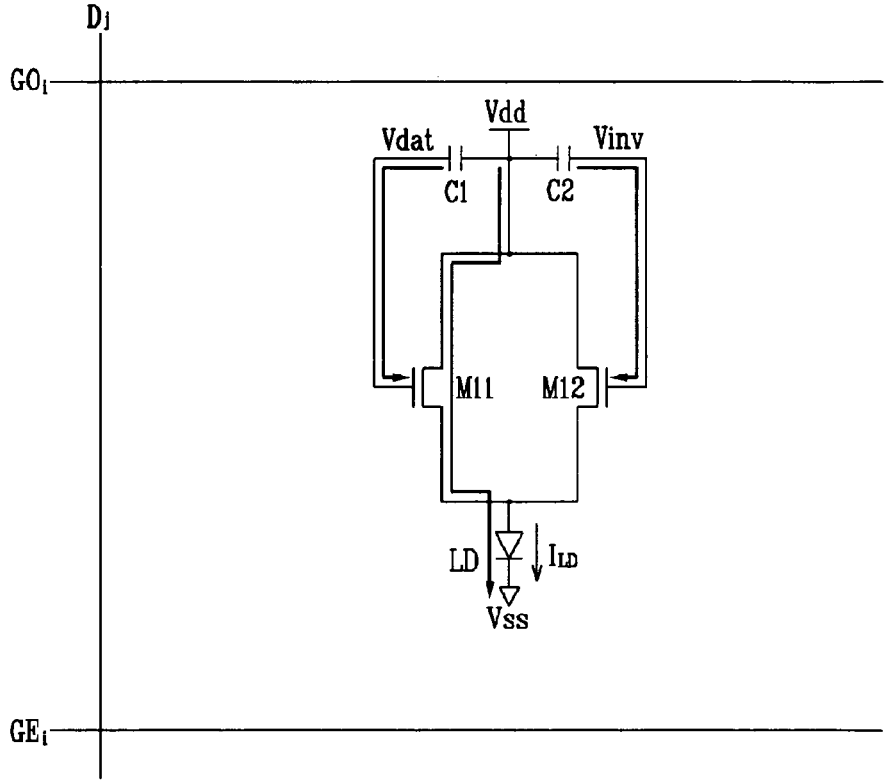
Figure 6C:
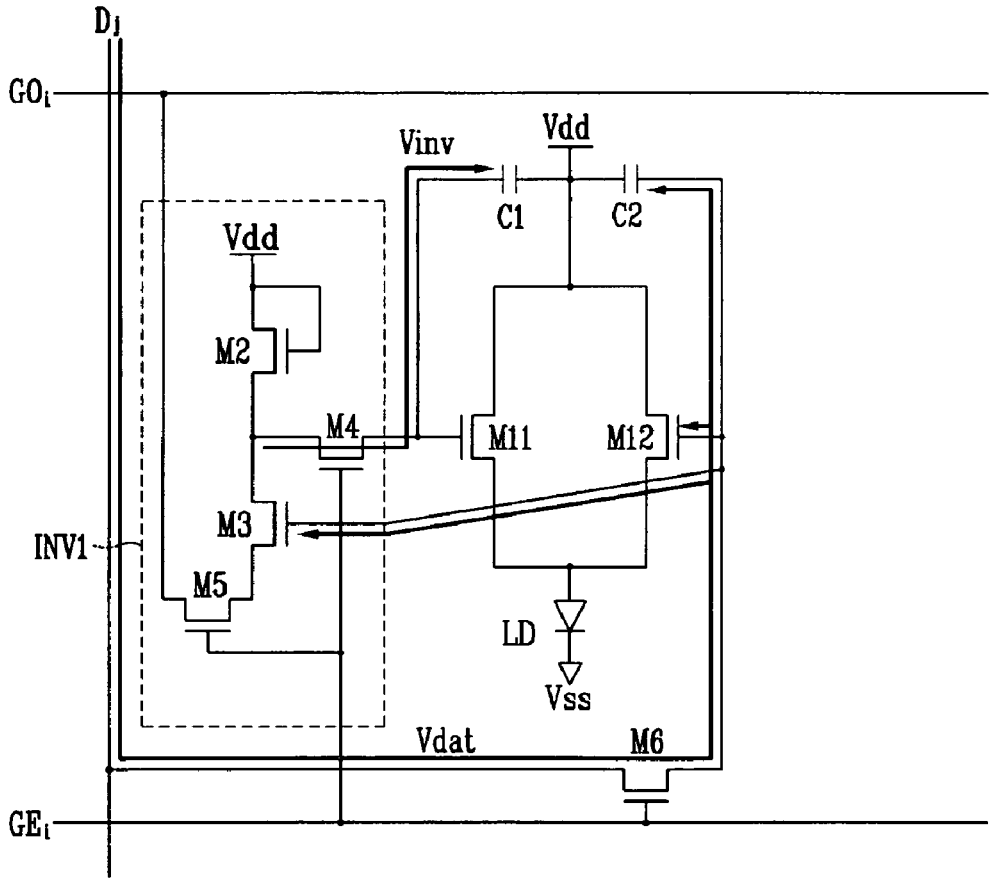
Figure 6D:
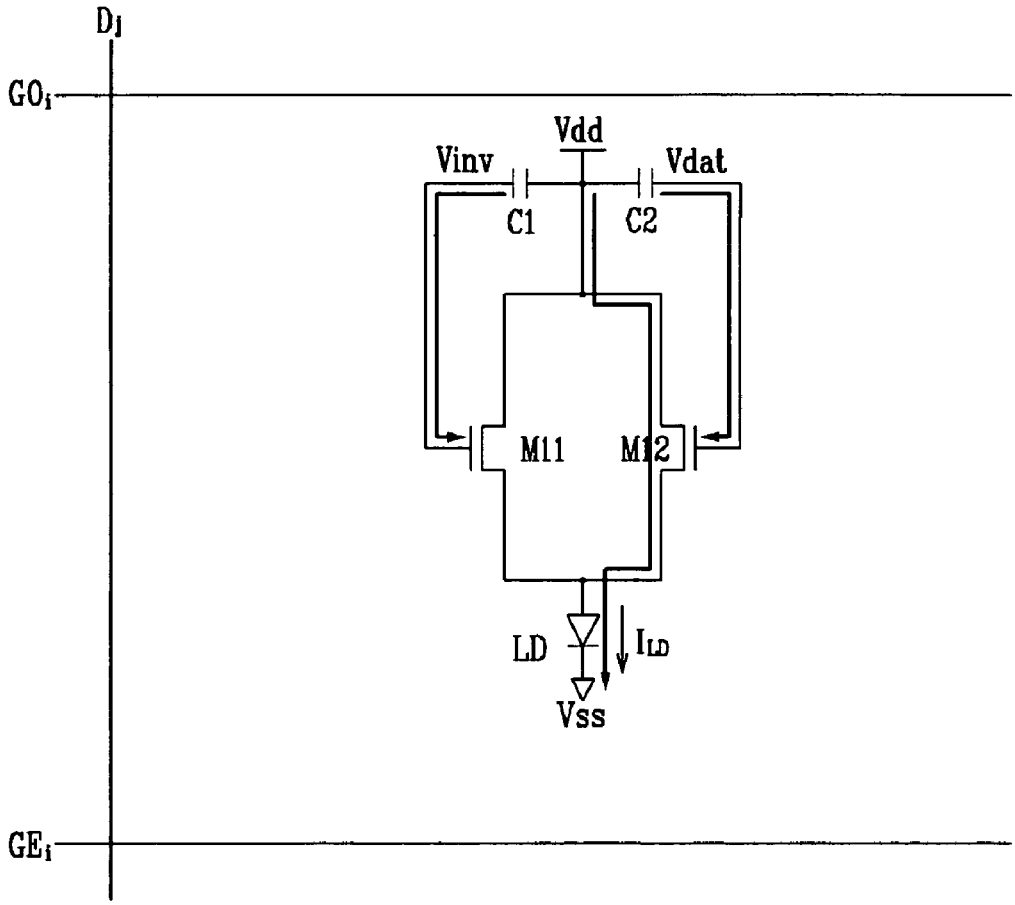
Figure 7:
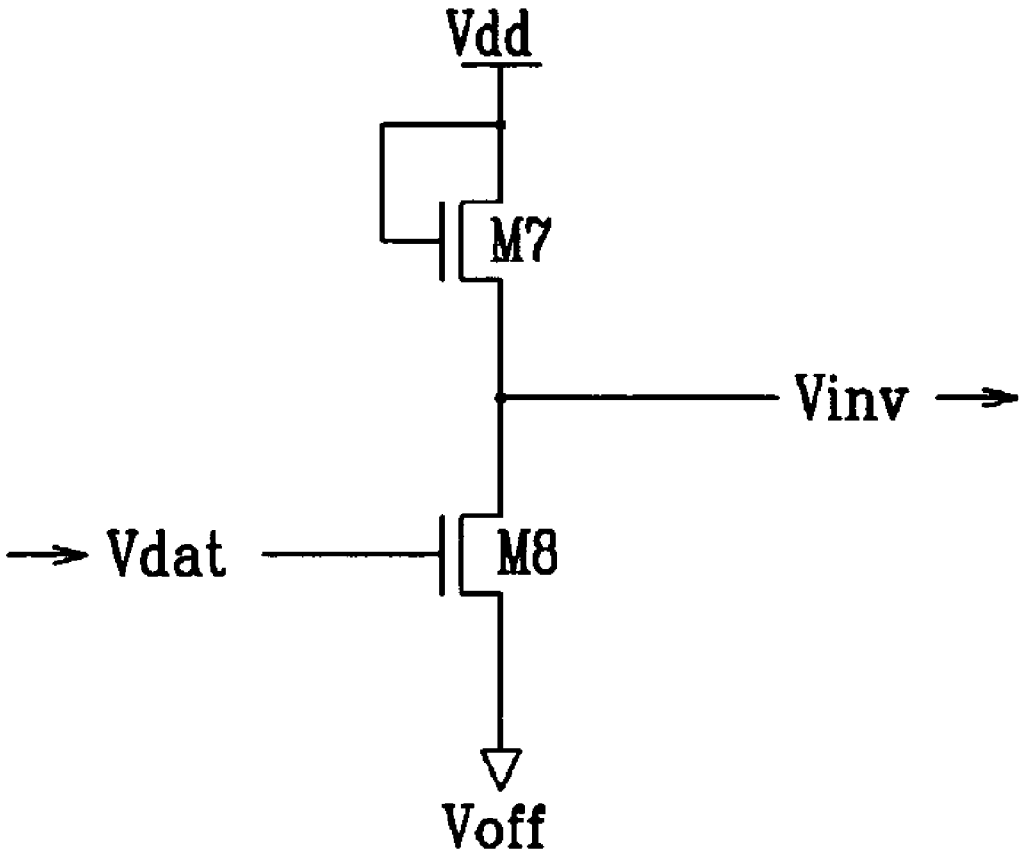
FIG. 7 illustrates operation of the inverters in the OLED display according to an embodiment of the present invention.

FIG. 5 is a timing chart of signals in an OLED display according to an embodiment of the present invention, FIGS. 6A, 6B, 6C and 6D are equivalent circuit diagrams of a pixel in time periods shown in FIG. 5, and FIG. 7 illustrates operation of the inverters in the OLED display according to an embodiment of the present invention.

The signal controller 600 is supplied with input image signals R, G and B and input control signals controlling the display thereof such as a vertical synchronization signal Vsync, a horizontal synchronization signal Hsync, a main clock MCLK, and a data enable signal DE, from an external graphics controller (not shown). After generating scanning control signals CONT1 and data control signals CONT2 and processing the image signals R, G and B suitable for the operation of the display panel 300 on the basis of the input control signals and the input image signals R, G and B, the signal controller 600 sends the scanning control signals CONT1 to the scanning driver 400 and the processed image signals DAT and the data control signals CONT2 to the data driver 500.

The scanning control signals CONT1 include a scanning start signal STV for instructing to start scanning in odd and even frames and at least one clock signal for controlling the output time of the gate-on voltage Von. The scanning control signals CONT1 may include a plurality of output enable signals for defining the duration of the gate-on voltage Von.

The data control signals CONT2 include a horizontal synchronization start signal STH for informing of start of data transmission for a group of pixels Px, a load signal LOAD for instructing to apply the data voltages to the data lines $D_1$-$D_m$, and a data clock signal HCLK.

Referring to FIG. 5, the signal controller 600 divides two frames into four time periods T1-T4 based on two scanning signals.

In the time period T1, in responsive to the data control signals CONT2 from the signal controller 600, the data driver 500 receives a packet of the image data for a i-th pixel row from the signal controller 600, converts the image data into analog data signals, and applies the data signals to the data lines $D_1$-$D_m$.

Referring to FIG. 6A, the scanning driver 400 changes the scanning signal VOi applied to a scanning line $GO_i$ into the gate-on voltage Von to the scanning line $GO_i$ in response to the scan control signals CONT1 from the signal controller 600, thereby turning on the transistors M1, M9 and M10 connected thereto. The data signals applied to the data lines $D_1$-$D_m$ are supplied to the control terminals of the driving transistor M11 and the capacitors C1 through the activated switching transistors M1 and the capacitors C1 store the data signals. The voltages of the capacitors C1 are maintained to keep the voltages between the control terminals and the output terminals of the driving transistors M11 after the switching transistors M1 are turned off.

In the meantime, since the scanning signal $VE_i$ is the gate-off voltage Voff, the transistors M4-M6 maintain their turn-off states.

Referring to FIG. 7, the data voltage Vdat is also applied to the control terminal of the transistor M8 of the inverter INV2.

The gate-off voltage Voff is applied to the input terminal of the transistor M8 through the activated transistor M10, and the diode-connected transistor M7 serves as an active load. The data voltage Vdat applied to the control terminal of the transistor M8 is higher than the voltage of the input terminal and the output terminal of the transistor M8, and thus the transistor M8 operates in a linear region. The inversion voltage Vinv outputted from the transistor M8 depends on the driving voltage Vdd, the gate-off voltage Voff, and the channel width/length of the transistors M7 and M8, and the inversion voltage Vinv is determined by the data voltage Vdat applied to the transistor M8. The inversion voltage Vinv is applied to the driving transistor M12 and the capacitor C2 through the activated transistor M9, and the capacitor C2 stores the inversion voltage Vinv. The inversion voltage Vinv may be negative and may have a magnitude depending on the data voltage Vdat, but it is optional.

Referring to FIG. 6B, the time period T2 starts when the scanning signal $VO_i$ becomes the gate-off voltage Voff and then the transistors M1, M9 and M10 turn off. However, although the transistors M1, M9 and M10 turn off, the data voltage Vdat and the inversion voltage Vinv stored in the capacitors C1 and C2, respectively, are maintained in the time period T2 and applied to the control terminals of the driving transistors M11 and M12. The driving transistor M11 is turned on by the data voltage Vdat to output a current $I_{LD}$ depending on the voltage Vdat. The current $I_{LD}$ flows in the organic light emitting diode LD such that the pixels Px displays images.

In the meantime, the inversion voltage Vinv applied to the control terminal of the driving transistor M12 reduces the shift of the threshold voltage of the driving transistor M12. That is, when a positive DC voltage is applied to the control terminal of the driving transistor M12 for a long time, the threshold voltage may be shifted as time lapses to degrade the image quality as described above. However, the negative inversion voltage Vinv reduces the stress exerted on the driving transistor M12 in the previous frame to reduce the shift of the threshold voltage.

During the time period T2, the scanning signal $VE_i$ maintains the gate-off voltage Voff and thus the transistors M4-M6 maintain their turn-off states. The time period T2 may have a length corresponding to one frame.

During the time frame T3 of a next frame, the data driver 500 receives the image data DAT for the i-th pixel row and converts the image data DAT into the data voltage Vdat to the data lines $D_1$-$D_m$.

Referring to FIG. 6C, the scanning driver 400 makes the scanning signal $VE_i$ applied to the gate line $GE_i$ in a high level to turn on the transistors M4-M6 connected to the gate line $GE_i$. Therefore, the data voltage Vdat applied to the data lines $D_1$-$D_m$ are transmitted to the driving transistor M12 and the capacitor C2 through the switching transistor M6 and the capacitor C2 stores the data voltage Vdat. Since the scanning signal $VO_i$ maintains its low voltage level, i.e., the gate-off voltage Voff, the transistors M1, M9 and M10 maintain their turn-off states.

The data voltage Vdat is also applied to the control terminal of the transistor M3 in the inverter INV1, the inverter INV1 generates the inversion voltage Vinv to apply to the capacitor C1 like the inverter INV2 in the time period T1. The capacitor C1 stores the inversion voltage Vinv.

Referring to FIG. 6D, when the scanning signal $VE_i$ becomes the gate-off voltage Voff to start the time period T4, the transistors M4-M6 turn off. However, although the transistors M4-M6 turn off, the inversion voltage Vinv and the data voltage Vdat stored in the capacitors C1 and C2, respectively, still maintain during the time period T4, and are applied to the control terminals of the driving transistors M11 and M12. The driving transistor M12 turns on by the data voltage Vdat to drive a current $I_{LD}$ depending on the voltage Vdat. The current $I_{LD}$ flows in the organic light emitting diode LD such that the pixels Px displays images.

In this way, the inversion voltage Vinv reduces the stress exerted on the driving transistor M11 to reduce the shift of the threshold voltage.

During the time period T4, the scanning signal $VO_i$ still maintains the gate-off voltage Voff to keep the transistors M1, M9 and M10 turned off. The length of the time interval T4 is nearly equal to one frame.

The time periods T1-T4 repeats and the driving transistors M11 and M12 alternately operates by unit of one frame. That is, the driving transistor M11 outputs the driving current $I_{LD}$ and the driving transistor M12 restores by the inversion voltage Vinv in the odd frames, while the driving transistor M12 outputs the driving current $I_{LD}$ and the driving transistor M11 restores by the inversion voltage Vinv in the even frames.

Now, simulations for the inversion voltages and the driving currents generated in the OLED display according to an embodiment of the present invention will be described in detail with reference to FIGS. 8A and 8B.

Figure 8A:
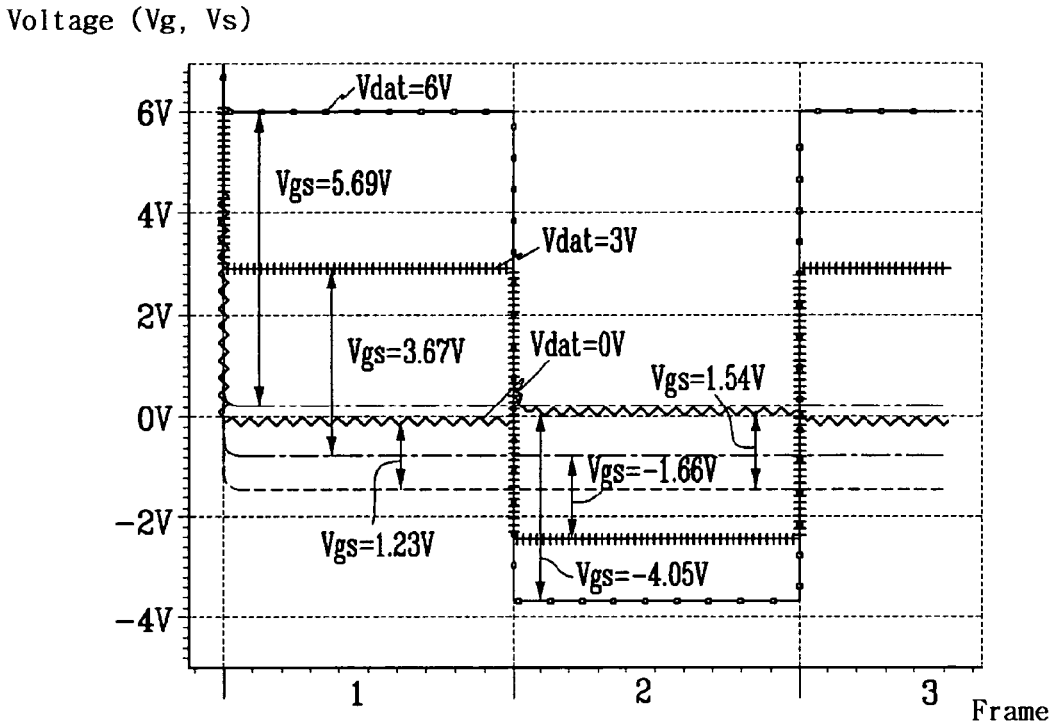
FIG. 8A shows an exemplary waveform of a control voltage of the driving transistor in an OLED display according to an embodiment of the present invention.
Figure 8B:
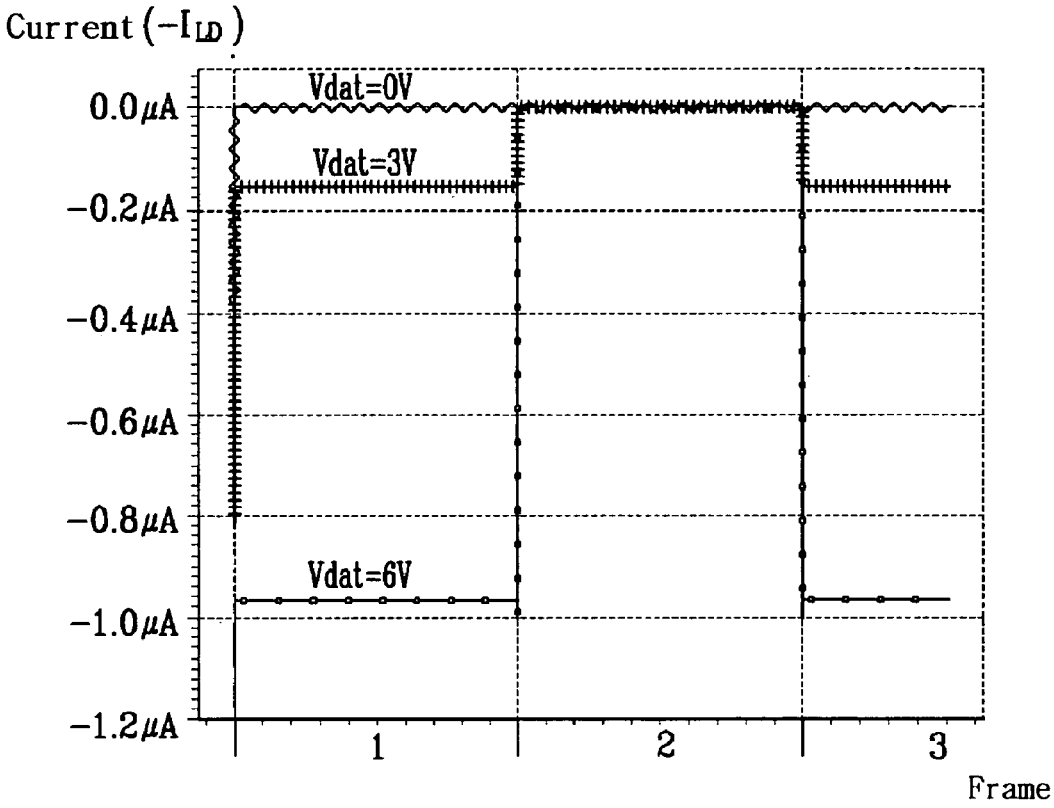
FIG. 8B shows an exemplary driving current of the driving transistor in an OLED display according to an embodiment of the present invention.

FIG. 8A shows an exemplary waveform of a control voltage of the driving transistor in an OLED display according to an embodiment of the present invention, and FIG. 8B shows an exemplary driving current of the driving transistor in an OLED display according to an embodiment of the present invention.

The waveform shown in FIG. 8A shows a control terminal voltage, an output terminal voltage, and a control voltage equal to the control terminal voltage subtracted by the output terminal voltage for the data voltages Vdat equal to 6V, 3V and 0V. Here, the control voltage Vg in the second frame is the inversion voltage Vinv generated by the inverter INV1.

The waveform shown in FIG. 8B shows the driving current $I_{LD}$ of the driving transistor M11.

The simulation was performed using "Smartspice" that is a kind of an analog circuit simulator. The driving transistors M11 and M12 had channel width and length equal to about 200 microns and 5 microns, respectively, the transistors M1, M3, M5, M6, M8 and M10 had channel width and length equal to about 200 microns and 5 microns, the transistors M2 and M7 had channel width and length equal to about 20 microns and 10 microns, and the transistors M4 and M9 had channel width and length equal to about 40 microns and 5 microns. The capacitances of the capacitors C1 and C2 were equal to about 0.3 pF. The gate-on voltage was equal to about 20V and the gate-off voltage Voff was equal to about −8V. The driving voltage Vdd was equal to about 10V, and the common voltage Vss was equal to about −4V.

In this condition, when the data voltage Vdat was equal to 6V, the control voltage Vgs in the first and the second frames were equal to about 5.69V and −4.05V, respectively. When the data voltage Vdat was equal to about 3V, the control voltage Vgs in the first and the second frames were equal to about 3.67V and −1.66V, respectively. When the data voltage Vdat was equal to 0V, the control voltage Vgs in the first and the second frames were equal to about 1.23V and 1.54V, respectively. In this case, the control voltage Vgs is smaller than the threshold voltage of the driving transistor M11, and thus the driving transistor M11 did not generate the driving current $I_{LD}$ as shown in FIG. 8B. In another case, the driving transistor M11 outputted the driving current $I_{LD}$ in the first frame, while the driving transistor M11 did not output the driving current $I_{LD}$ in the second frame.

According the simulation, the inverter INV1 generates the negative inversion voltage Vinv in the second frame to apply to the driving transistor M11 and thus the driving transistor M11 is reversely biased. Therefore, the stress exerted on the driving transistor M11 in the first frame due to the positive data voltage Vdat is alleviated. In the meantime, the low control voltage Vgs does not affect the shift and the restore of the threshold voltage of the driving transistor M11.

To summarize, the OLED display according to the embodiments includes two inverters and two driving transistors such that the two driving transistors alternately perform display operation and restore operation frame by frame to reduce the shift of the threshold voltage, thereby increasing the lifetime of the OLED.

Although preferred embodiments of the present invention have been described in detail hereinabove, it should be clearly understood that many variations and/or modifications of the basic inventive concepts herein taught which may appear to those skilled in the present art will still fall within the spirit and scope of the present invention, as defined in the appended claims.

What is claimed is:

1. A display device comprising a plurality of pixels, each pixel comprising:

a light emitting element;

first and second driving transistors connected between a driving voltage and the light emitting element and supplying a driving current to the light emitting element;

a first switching transistor transmitting a data voltage to the first driving transistor;

a second switching transistor transmitting the data voltage to the second driving transistor;

a first scanning line transmitting a first scanning signal to the first switching transistor;

a second scanning line transmitting a second scanning signal to the second switching transistor;

a first inverter generating a first inversion voltage having an amplitude that depends on the data voltage and a polarity opposite to the data voltage transmitted to the second driving transistor and applying the first inversion voltage to the first driving transistor; and a second inverter generating a second inversion voltage having an amplitude that depends on the data voltage and a polarity opposite to the data voltage transmitted to the first driving transistor and applying the second inversion voltage to the second driving transistor, wherein the first inverter comprises:

a first thin film transistor connected to the driving voltage and having a diode connection; and a second thin film transistor connected between the first thin film transistor and the first scanning line and transmitting the first inversion voltage according to the data voltage, and the second inverter comprises:

a third thin film transistor connected to the driving voltage and having a diode connection; and a fourth thin film transistor connected between the third thin film transistor and the second scanning line and transmitting the second voltage according to the data voltage.

2. The display device of claim 1, wherein the first and the second driving transistors alternately output the driving current frame by frame.

3. The display device of claim 2, wherein the first and the second switching transistors alternately turn on and off frame by frame.

4. The display device of claim 3, wherein the first and the second inverters alternately generate the first and second inversion voltage frame by frame.

5. The display de ice of claim 2, wherein when the data voltage is applied to the first driving transistor, the second inversion voltages is applied to the second driving transistor, and when the data voltage is applied to the second driving transistor, the first inversion voltage is applied to the first driving transistor.

6. The display device of claim 1, wherein the first and second inversion voltages have magnitude substantially proportional to a magnitude of the data voltage.

7. The display device of claim 1, further comprising: a first capacitor storing the data voltage and the first version voltage and supplying the data voltage and first inversion voltage to the first driving transistor; and a second capacitor storing the data voltage and the second inversion voltage and supplying the data voltage and the second inversion voltage to the second driving transistor.

8. The display device of claim 7, wherein when the first capacitor supplies the data voltage, the second capacitor supplies the second inversion voltage, and when the second capacitor supplies the data voltage, the first capacitor supplies the first inversion voltage.

9. The display device of claim 1, further comprising:

a data line supplying the data voltage.

10. The display device of claim 1, wherein the first inverter comprises:

a fifth thin film transistor operating in response to the second scanning signal and connected between the first driving transistor and a node between the first thin film transistor and the second thin film transistor; and a sixth thin film transistor operating in response to the second scanning signal and connected between the second thin film transistor and the first scanning line, and the second inverter comprises:

a seventh thin film transistor operating in response to the first scanning signal and connected between the second driving transistor and a node between the third thin film transistor and the fourth thin film transistor; and an eighth thin film transistor operating in response to the first scanning signal and connected between the fourth thin film transistor and the second scanning line.

11. A display device comprising:

a light emitting element;

a first driving transistor having an input terminal connected to a driving voltage, an output terminal connected to the light emitting element, and a control terminal;

a second driving transistor having an input terminal connected to the driving voltage, an output terminal connected to the light emitting element, and a control terminal;

a first switching transistor operating in response to a first scanning signal and connected between a data voltage and the control terminal of the first driving transistor;

a second switching transistor operating in response to a second scanning signal and connected between the data voltage and the control terminal of the second driving transistor;

a first thin film transistor connected to the driving voltage and having a diode connection;

a second thin film transistor operating in response to the data voltage and connected between the first thin film transistor and the first scanning signal;

a third thin film transistor connected to the driving voltage and having a diode connection; and a fourth thin film transistor operating in response to the data voltage and connected between the third thin film transistor and the second scanning signal.

12. The display device of claim 11, further comprising:

a first capacitor connected to the control terminal of the first driving transistor; and a second capacitor connected to the control terminal of the second driving transistor.

13. The display device of claim 12, further comprising:

a data line supplying the data voltage; and a first scanning line transmitting the first scanning signal; and a second scanning line transmitting the second scanning signal.

14. The display device of claim 13, further comprising:

a fifth thin film transistor operating in response to the second scanning signal and connected between the second thin film transistor and the first driving transistor;

a sixth thin film transistor operating in response to the second scanning signal and connected between the second thin film transistor and the first scanning signal;

a seventh thin film transistor operating in response to the first scanning signal and connected between the fourth thin film transistor and the second driving transistor; and an eighth thin film transistor operating in response to the first scanning signal and connected between the fourth thin film transistor and the second scanning signal.

15. The display device of claim 11, wherein the first and the second signals alternately become a gate-on voltage.

16. The display device of claim 11, wherein the inversion voltage has a magnitude substantially in proportion to a magnitude of the data voltage.

17. A method of driving a display device including a light emitting element, first and second driving transistors connected to the light emitting element, first and second capacitors connected to the first and the second driving transistors, respectively, first and second switching transistors connected between a data voltage and the first and the second driving transistors, respectively, first and second inverters connected to the first and the second driving transistors, respectively, the method comprising:

applying the data voltage to the first driving transistor in a first frame;

generating a first inversion voltage having a polarity opposite the data voltage according to the data voltage in the first frame;

applying the first inversion voltage to the second driving transistor in the first frame;

applying the data voltage to the second driving transistor in a second frame following the first frame;

generating a second inversion voltage having a polarity opposite the data voltage according to the data voltage in the second frame; and applying the second inversion voltage to the first driving transistor in the second frame, wherein the first inverter comprises:

a first thin film transistor connected to a driving voltage and having a diode connection; and a second thin film transistor connected between the first thin film transistor and a first scanning line transmitting a first scanning signal to the first switching transistor, the second thin film transistor transmitting the second inversion voltage according to the data voltage, and the second inverter comprises:

a third thin film transistor connected to the driving voltage and having a diode connection; and a fourth thin film transistor connected between the third thin film transistor and a second scanning line transmitting a second scanning signal to the second switching transistor, the fourth thin film transistor transmitting the first inversion voltage according to the data voltage.

18. The method of claim 17, further comprising:

applying the data voltage to the first capacitor in the first frame;

applying the first inversion voltage to the second capacitor in the first frame;

applying the second inversion voltage to the first capacitor in the second frame; and applying the data voltage to the second capacitor in the second frame.

19. The method of claim 17, wherein each of the first and the second inversion voltages has a magnitude substantially proportional to a magnitude of the data voltage.

* * * * *